US010214371B2

(12) United States Patent
Osborne, Jr.

(10) Patent No.: US 10,214,371 B2
(45) Date of Patent: Feb. 26, 2019

(54) FOLDED TOWEL DISPENSER WITH DIRECTIONAL RIBS

(75) Inventor: Charles Agnew Osborne, Jr., Cumming, GA (US)

(73) Assignee: SOLARIS PAPER, INC., Alpharetta, GA (US)

( * ) Notice: Subject to any disclaimer, the term of this patent is extended or adjusted under 35 U.S.C. 154(b) by 240 days.

(21) Appl. No.: 13/991,406

(22) PCT Filed: Dec. 5, 2011

(86) PCT No.: PCT/US2011/063321

§ 371 (c)(1),
(2), (4) Date: Aug. 23, 2013

(87) PCT Pub. No.: WO2012/075502

PCT Pub. Date: Jun. 7, 2012

(65) Prior Publication Data

US 2013/0319898 A1 Dec. 5, 2013

Related U.S. Application Data

(60) Provisional application No. 61/419,445, filed on Dec. 3, 2010.

(51) Int. Cl.
*B65H 3/00* (2006.01)
*A47K 10/42* (2006.01)

(52) U.S. Cl.
CPC ..... *B65H 3/00* (2013.01); *A47K 10/424* (2013.01)

(58) Field of Classification Search
CPC ..... A47K 10/24; A47K 10/32; A47K 10/42; A47K 10/424; A47K 10/44; A47K 2010/3233; B65H 3/00
USPC ..... 221/45, 63
See application file for complete search history.

(56) References Cited

U.S. PATENT DOCUMENTS 3,713,561 A * 1/1973 Wyant ..... 221/44
5,118,554 A 6/1992 Chan
5,199,601 A * 4/1993 Roethel ..... A47F 1/085 221/302
5,950,863 A * 9/1999 Schutz ..... A47K 10/424 221/197
6,286,713 B1 * 9/2001 Chan ..... A47K 10/426 221/33
6,315,155 B1 * 11/2001 Hubanks ..... A47K 10/424 221/38
6,543,641 B2 * 4/2003 Hubanks ..... A47K 10/424 221/34

(Continued)

FOREIGN PATENT DOCUMENTS

WO 1998022009 5/1998

OTHER PUBLICATIONS

PCT Search Report and Written Opinion dated Apr. 5, 2012 for PCT/US11/63321 entitled Folded Towel Dispensers With Directional Ribs filed Dec. 5, 2011.

*Primary Examiner* — Gene O Crawford
*Assistant Examiner* — Kelvin L Randall, Jr.
(74) *Attorney, Agent, or Firm* — Fish IP Law, LLP

(57) ABSTRACT

A dispenser for dispensing folded paper towels is described. The dispenser includes several ribs near the dispensing throat. The ribs are uniquely configured to guide the paper towels towards the throat in a bowed fashion, thus reducing the frequency of tears.

16 Claims, 4 Drawing Sheets

(56) References Cited

U.S. PATENT DOCUMENTS

| | | | | |
|---|---|---|---|---|
| 6,575,329 | B2 * | 6/2003 | Clark | A47K 10/424 221/45 |
| 6,877,634 | B2 * | 4/2005 | Tramontina | A47K 10/424 221/311 |
| 7,568,593 | B2 * | 8/2009 | Cittadino et al. | 221/59 |
| 2001/0020624 | A1 * | 9/2001 | Hubanks et al. | 221/45 |
| 2002/0179624 | A1 * | 12/2002 | Tramontina | 221/33 |
| 2003/0071050 | A1 * | 4/2003 | Clark | A47K 10/424 221/45 |
| 2005/0178782 | A1 * | 8/2005 | Christensen et al. | 221/47 |
| 2011/0259908 | A1 * | 10/2011 | Case et al. | 221/45 |
| 2014/0106117 | A1 * | 4/2014 | Hochtritt et al. | 428/126 |

* cited by examiner

FIG. 1
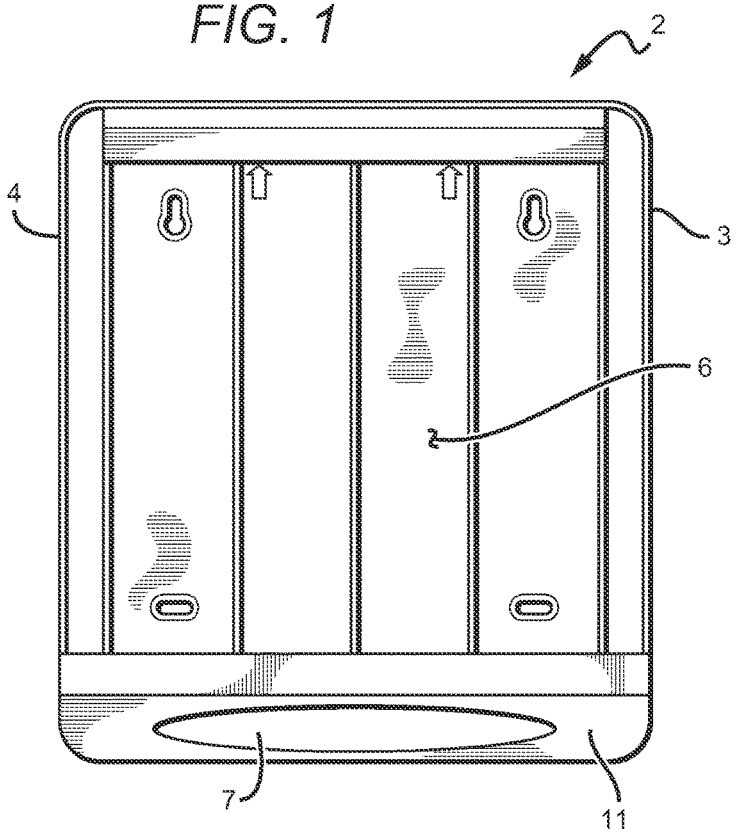
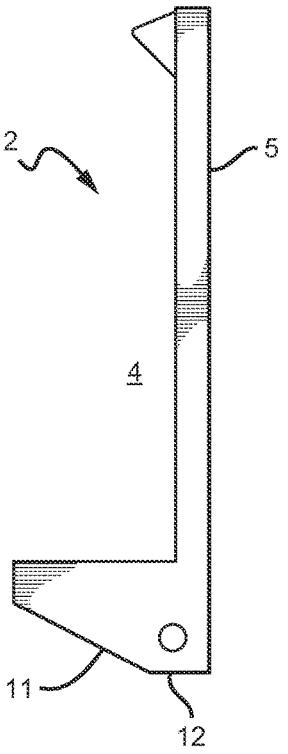
FIG. 2
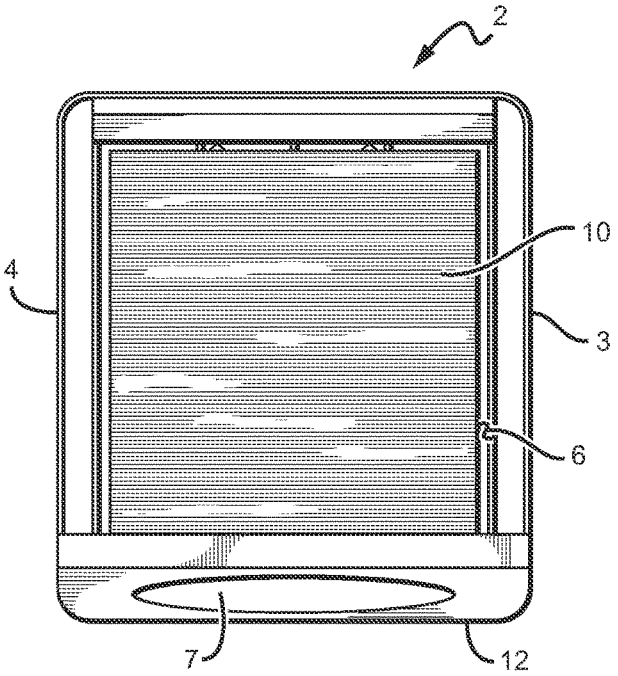
FIG. 3

FIG. 4
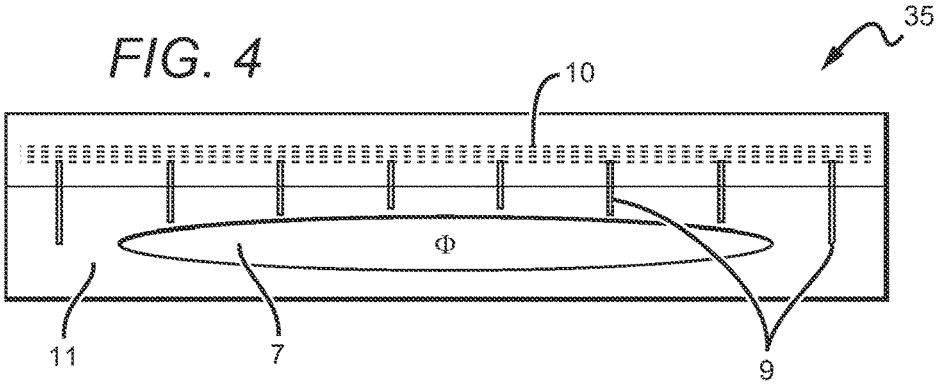
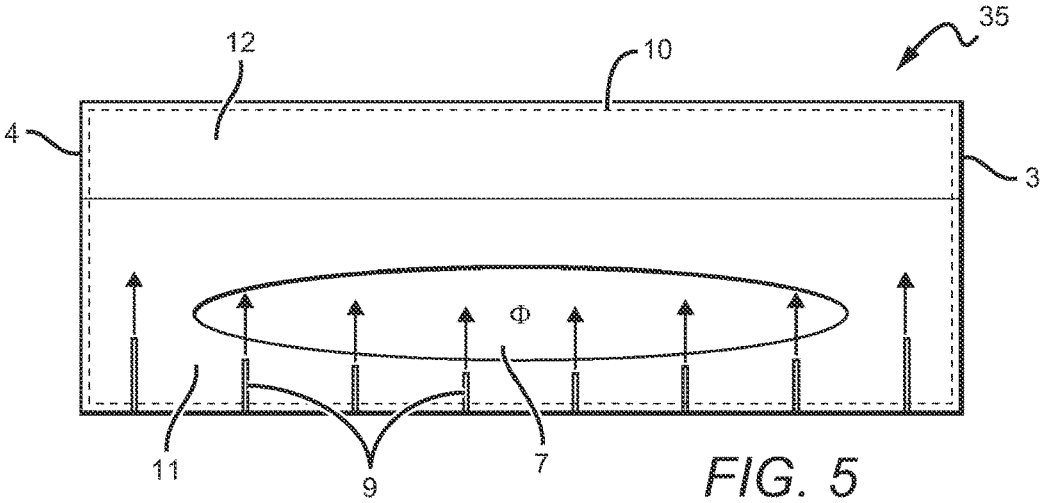
FIG. 5
FIG. 6
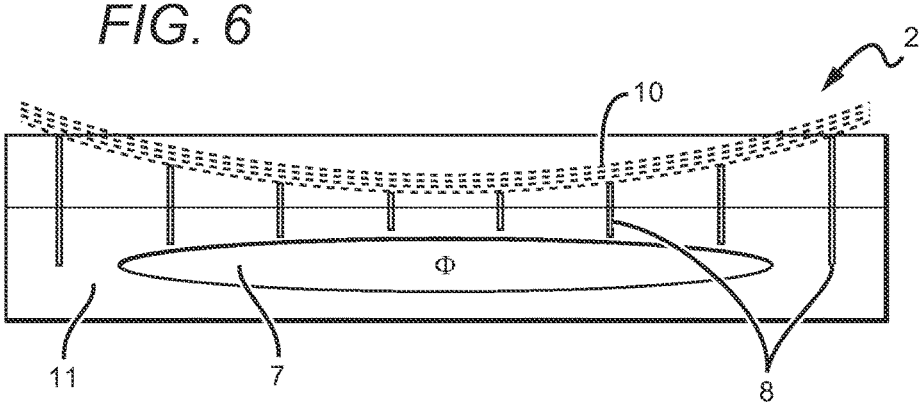

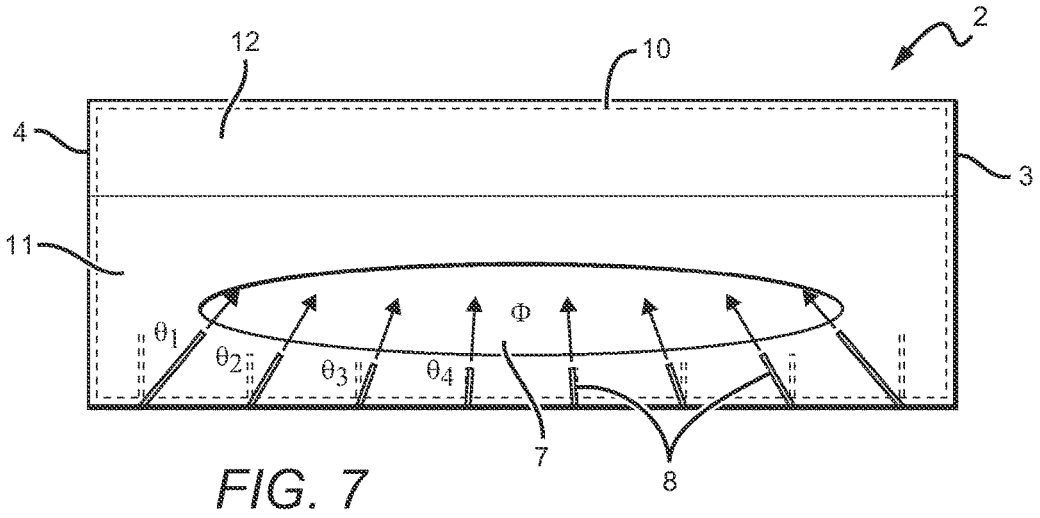
FIG. 7
FIG. 8
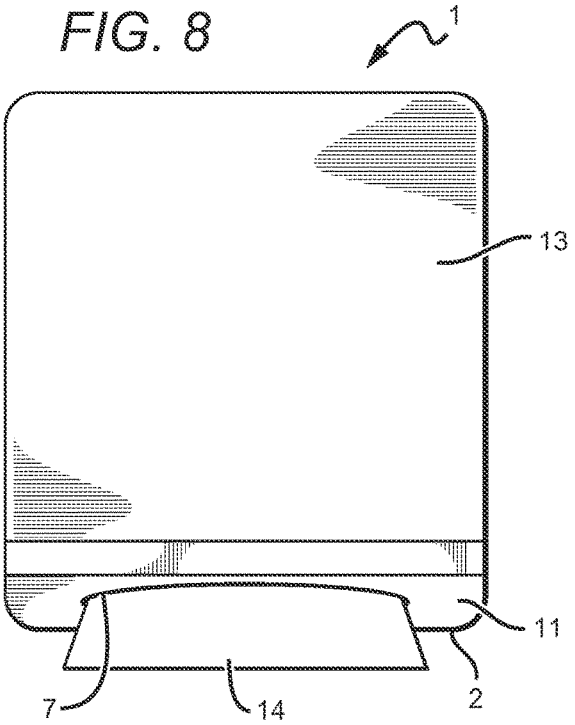
FIG. 11
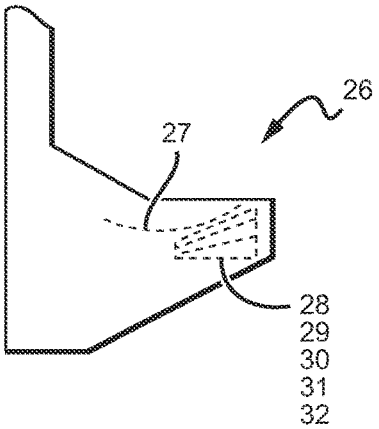

FOLDED TOWEL DISPENSER WITH DIRECTIONAL RIBS

This application claims the benefit of priority to provisional application Ser. No. 61/419,445 filed on Dec. 3, 2010. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention relates to sheet dispensers, more particularly, dispensers for folded and stacked paper towels.

BACKGROUND

Paper towel dispensers are well known and generally comprise a housing for storing a stack of paper towels and a throat for dispensing the towels from the housing. Such dispensers are commonly used in commercial and institutional settings and conveniently provide the public with access to absorbent paper towels.

Recently, multi-fold towels having enhanced softness and absorption have been introduced into the market. While the enhanced softness and absorption is desirable, it has lead to towels having significantly reduced strength. Consequently, the reduced strength has lead to more frequent occasions of tearing when the towel is dispensed from the throat of a dispenser, especially when grasped by wet fingers. There is a significant need for dispensers that reduce friction between the towels and throat in order to compensate for the reduced strength of enhanced softness paper towels.

Various types of dispensers have been directed at reducing the friction between folded paper towels and dispenser throats during dispensing. For example, some napkin dispensers include pairs of bumpers with ribs. The ribbed bumpers are located near the throat of the dispenser and cause the interfolded napkins to bow out and buckle into the dispensing throat. The bowed shape of the napkin is believed to aid the dispensing of the napkin and reduce drag and tear.

In a similar vein, certain kinds of paper towel dispensers have several flat ribs on the interior walls of the dispenser near the throat opening. The rib profiles, sizes, and locations are uniquely chosen to reduce the friction between the dispenser and the folded towels, thus decreasing the likelihood of tears and other dispensing failures.

While prior art dispensers have sought to address the problem of tearing, numerous disadvantages remain. It has yet to be appreciated that a folded towel dispenser can include directional ribs having different height profiles, thus guiding the towels to the center of the throat opening in a bowed fashion.

Thus, there is still a need for folded towel dispensers with improved dispensing efficiency.

SUMMARY OF THE INVENTION

The inventive subject matter provides apparatus, systems and methods in which a folded paper product dispenser stores a plurality of folded paper products in the interior space of the dispenser housing. One of the wall surfaces of the housing has a throat (e.g., opening) for dispensing the folded paper products (e.g., paper towels, napkins). The dispenser also has at least three ribs disposed within the housing's interior space and positioned near the throat. In some embodiments, the ribs extend from the same wall surface where the dispensing throat is located. The three ribs have upper surfaces configured to contact the folded paper product such that the paper product is bowed when resting against the upper surfaces. In other words, the upper surfaces form a hypothetical convex surface. In some embodiments, the ribs are gradually angled towards the center of the throat to greater degrees as the ribs are located farther from the center. In this manner, the ribs are configured to guide paper product towards the center of the dispenser throat.

In some embodiments, the housing wall surfaces include a front, a back, a left side, a right side, a top, an angled bottom and a flat bottom. In such embodiments, the dispensing throat and three ribs are located on the angled bottom. It is also contemplated that the angled bottom could include more than three ribs.

In other aspects of some embodiments, the dispensing throat has an elliptical shape with a first concave edge and a second concave edge. However, other shapes and sizes of throats are also contemplated.

In yet other aspects of some embodiments, each of the three ribs have height profiles configured such that the outer ribs' height profiles are greater than the middle rib's height profile at any given corresponding location along the profiles. In this manner, the three rib height profiles form a generally convex hypothetical surface. Additional ribs could be included to form the generally convex hypothetical surface.

In other embodiments, the three ribs include a first rib located near the center of the dispensing throat, and the second and third ribs are located further from the center of the dispensing throat than the first rib. The second and third ribs are located on opposite sides of the first rib. The shape of the ribs can be linear, non-linear, or even irregular.

Various objects, features, aspects and advantages of the inventive subject matter will become more apparent from the following detailed description, along with the accompanying drawing figures in which like numerals represent like components.

BRIEF DESCRIPTION OF THE DRAWING

FIG. 1 is a front view of a dispenser with the front cover removed, showing the dispensing throat and an interior space for storing paper products.

FIG. 2 is a side view of the dispenser of FIG. 1.

FIG. 3 is a front view of the dispenser of FIG. 1, with folded paper product stored in the dispenser's interior space.

FIG. 4 is a front view of a dispenser that has straight ribs with even height profiles.

FIG. 5 is a top view of a dispenser with straight ribs and even height profiles.

FIG. 6 is a front view of the dispenser of FIG. 1, showing the uneven height profiles of the ribs.

FIG. 7 is a top view of the dispenser of FIG. 1 showing the angled ribs having gradually increasing angels the farther the ribs are located from the center of the throat.

FIG. 8 is a front view of the dispenser of FIG. 1 with the front cover on, folded paper product in the interior space, and a sheet of paper product disposed in the throat and ready for dispensing.

FIG. 11 is a side view of the dispenser of FIG. 10.

DETAILED DESCRIPTION

Figure 9:
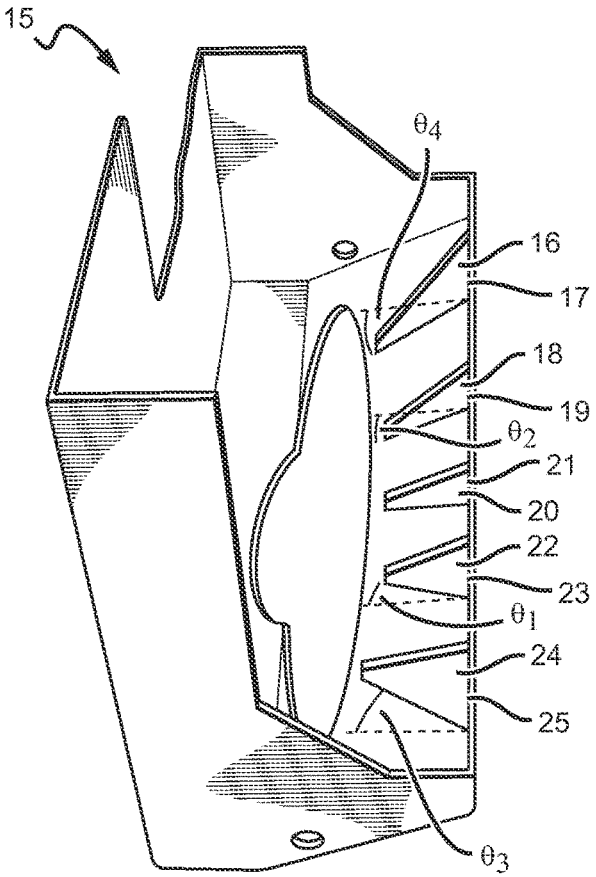
FIG. 9 is a perspective view of the dispenser of FIG. 1.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIG. 1 shows a front view of a folded towel dispenser back 2, without a front cover 13. Dispenser back 2 includes a housing left side 4, housing right side 3, and angled bottom dispensing face 11, all of which form an interior 6 for storing folded paper product 10. Dispensing face 11 also contains dispensing throat 7 for dispensing folded paper product 10 from dispenser 1 (see FIG. 8). While dispenser back 2 is shown in FIG. 1 as having separate distinct sides and walls, it is also contemplated that dispenser back 2 could comprise one continuous wall formed by different surfaces having varied curvatures.

Dispensing throat 7 is shown as having an elliptical shape with a first concave edge and a second concave edge. Those of skill in the art will appreciate that numerous shapes and sizes of throat 7 can be used consistently with the inventive subject matter disclosed herein. The present application is not intended to be limited by a particular shape of throat 7.

FIG. 2 is a side view of the folded towel dispenser back 2, showing housing back vertical wall 5. Also shown is housing flat bottom face 12 and angled bottom dispensing face 11, which contains dispensing throat 7 (not shown). Interior 4 is empty and is ready for folded paper product 10 to be loaded into place.

FIG. 3 is a front view of the folded towel dispenser back 2, with folded paper product 10 loaded into interior 4. Front cover 13 is still removed, thus exposing folded paper products 10.

FIGS. 4 and 5 are a front and top views, respectively, of the lower section of a folded towel dispenser back 35. Dispenser back 35 is similar to dispenser back 2, except that dispenser back 35 has straight ribs 9 with even height profiles, while dispenser back 2 has angled ribs 8 with varying height profiles (compare FIGS. 4 and 5 with FIGS. 6 and 7). Dispenser back 35 is shown as a clear or see-through material in order to show folded paper product 10 (shown with dashed lines) lying horizontally across the top of ribs 9. The front view in FIG. 4 demonstrates how ribs 9 have even heights for corresponding locations of height profiles on each rib. As used herein, the phrase "corresponding locations of height profiles" means locations on different ribs that have the same R-value, where R-value is the ratio: (i) the length from the location to a first end of the rib over (ii) the overall length of the rib. The first end can be defined by either the end nearest to the throat or the end farthest from the throat. It does not matter, as long as the first end is defined consistently for each rib.

The top view in FIG. 5 demonstrates how ribs 9 are straight with respect to sides 3 and 4 and parallel to one another. The arrows show the direction folded paper product 10 will move when pulled from dispensing throat 7.

FIGS. 6 and 7 are front and top views, respectively, of the lower section of folded towel dispenser back 2. Dispenser back 2 has angled ribs 9 with varying height profiles. Again, dispenser back 2 is shown as a clear or see-through material in order to show folded paper product 10 (shown with dashed lines) resting across the top of angled ribs 8. The front view in FIG. 6 demonstrates how ribs 8 have uneven heights for corresponding locations of height profiles on each rib. Specifically, ribs closer to the center of throat 7 have smaller heights while ribs farther from the center of throat 7 have larger heights. (The center of throat 7 is denoted by the Φ symbol.) As such, folded paper product 10 is held in a convex fashion (i.e., folded paper product 10 is bowed towards the throat).

The top view in FIG. 7 demonstrates how ribs 8 are angled towards the center of throat 7. The degree of angle increases for each rib as the ribs are located farther from the center of throat 7. For example, $\theta_1>\theta_2>\theta_3>\theta_4$.

Ribs 8 comprise 8 equally spaced ribs, wherein four ribs are located laterally and to the right of the center of throat 7 and the other four ribs are located laterally to the left. As used herein, the term "laterally" means to the side of the center of the throat, with respect to a unique length of the throat. For example, throat 7 has a unique length crossing from housing right side 3 to housing left side 4. In embodiments where the shape of throat 7 is circular (i.e., the throat has no unique length), the positions of the ribs with respect to one another can be distinguished either by referencing a radial location with respect to the center of the throat, or by referencing the rib locations with respect to the housing.

Those of skill in the art will appreciate that many variations in the number, spacing, positioning, height profiles, and angles of the ribs are possible and can be used consistently with the inventive concepts disclosed herein. For example, in alternative embodiments, the plurality ribs could comprise five ribs spaced apart unequally. In other embodiments, some of the ribs may have a height profile that violates the trend of gradually increasing in height the farther the rib is located from the center of throat 7. As long as the majority of the ribs form a hypothetical convex surface, ribs of varying configurations can be added without departing from the inventive concepts disclosed herein. Similarly, those of skill in the art will also appreciate that some of the ribs may be angled in a manner that violate the trend of increasing angularity the farther the rib is located from the center of throat 7. As long as the majority of the ribs are configured to guide a sheet of paper product towards the center of the throat, varying rib configurations can be added without departing from the inventive concepts.

Ribs 8 are specifically configured to guide folded paper product 10 toward throat 7 as sheets of paper product are pulled across the angled lengths of ribs 8. Angled ribs 8 advantageously reduce friction between paper products 10 and throat 7, more so than ribs 9.

FIG. 8 is a front view of folded towel dispenser assembly 1, which includes dispenser back 2 and front cover 13. Folded paper product 10 is loaded within interior 4 of dispenser assembly 1 and sheet 14 is ready to be dispensed through throat 7.

Dispenser assembly 1 is a vertical dispenser and utilizes gravity and the weight of preceding paper product to push sheets of paper product towards throat 7. However, non-vertical dispenser assemblies can also be used consistently with the inventive concepts disclosed herein. For example, a horizontal dispenser assembly with a spring placed to push the folded paper products 10 towards throat 7 could also be used.

FIG. 9 is a perspective view of a cutout of a folded towel dispenser back 15. Dispenser back 15 has a total of five ribs extending from an interior wall surface: rib 16, 18, 20, 22, and 24. The ribs are configured with varying height profiles such that their upper surfaces form a boundary of a convex hypothetical surface. In addition, the lengths of the ribs are angled towards the center of the dispenser's throat in a gradually increasing degree as the ribs are located farther from the center of the throat. Rib 20 is positioned at the proximate center of the throat and is substantially non-angled with respect to the dispenser's sidewalls. Ribs 16, 18, 20, 22, and 24 are uniquely configured to bow folded paper product and guide the paper product out of the dispenser throat.

It should be noted that one skilled in the art could increase or decrease the number of ribs depending on the length of the folded paper product and shape of the dispenser throat. The exact number of ribs is not intended to limit the inventive subject matter.

Figure 10:
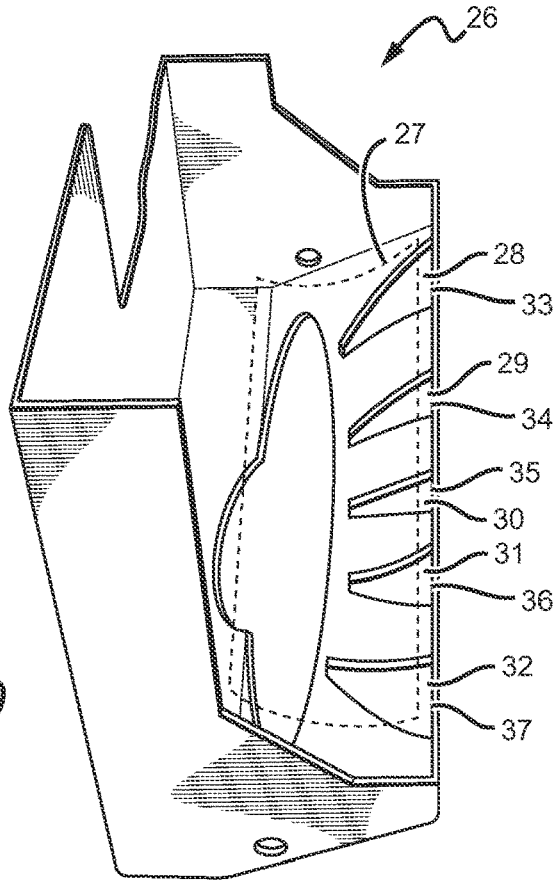
FIG. 10 is a perspective view of another embodiment of a dispenser that has angled ribs with varying height profiles.

FIG. 10 is a perspective view of a cutout of a folded towel dispenser back 26. Dispenser back 26 has a total of five ribs extending from an interior wall surface: rib 28, 29, 30, 31, and 32. Unlike the ribs in FIG. 9, the length of the ribs in FIG. 10 non-linear (e.g., curved). Even though ribs 28-32 are curved, the lengths of each rib are generally angled towards the center of the dispenser's throat in increasing degrees as the ribs are located farther from the center of the throat. In other words, the ribs are angled "along their length" towards the center of the throat. One of skill in the art will appreciate that numerous shapes, including irregular shapes (e.g., wave or "S"), can be used without departing from the inventive concepts disclosed herein.

Ribs 28-32 each have upper surfaces 33-37, respectively. Together, surfaces 33-37 form a hypothetical convex surface 27. In other words, surfaces 33-37 are all located within the same convex surface. Ribs 28-32 help to (i) create a bowed sheet of paper product and (ii) guide the exiting sheet of paper product out of the throat. FIG. 11 shows a side view of dispenser back 26. The profile of hypothetical convex surface 27 is clearly shown as following the contours of the upper surfaces of ribs 28-32. Surface 27 is convex in the direction perpendicular to the length of the ribs 28-32 (the left-to-right direction in FIG. 6) and is also convex in the direction that is parallel to the length of ribs 27 (the left-to-right direction in FIG. 11). Ribs 28-32 are configured to create this unique hypothetical surface in order to decrease the frequency of tears. However, it is also contemplated that other embodiments could include ribs that are configured to create a hypothetical convex surface that is only convex in one of either the normal or perpendicular direction with respect to the length of the ribs.

While the present application specifically discusses dispensers for folded paper products, the inventive subject matter is equally applicable to non-fold, non-paper, non-absorbent stacks of sheet material. The present subject matter is not intended to be limited by the term "folded paper products."

Unless the context dictates the contrary, all ranges set forth herein should be interpreted as being inclusive of their endpoints and open-ended ranges should be interpreted to include commercially practical values. Similarly, all lists of values should be considered as inclusive of intermediate values unless the context indicates the contrary.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A dispenser for storing and dispensing a plurality of paper products comprising:

a housing having first and second wall surfaces that define an interior space configured to accommodate the plurality of paper products;

a dispensing throat defined in at least one of the wall surfaces of the housing;

a plurality of ribs at least partially disposed within the interior space, including a first rib located between second and third ribs, and the second and third ribs are laterally disposed relative to a center of the throat;

wherein first, second, and third ribs have first, second, and third surfaces, respectively, configured to form a boundary of a convex surface; and wherein the second and third ribs are angled along their length towards the throat center at a greater angle than the angle of the first rib.

2. The dispenser of claim 1, wherein the walls of the housing include a front, a back, a left side, a right side, a top, an angled bottom and a flat bottom.

3. The dispenser of claim 2, wherein the dispensing throat is located on the angled bottom.

4. The dispenser of claim 1, wherein the dispensing throat has an elliptical shape with a first concave edge and a second concave edge.

5. The dispenser of claim 2, wherein the first, second, and third ribs are disposed on an interior surface of the angled bottom.

6. The dispenser of claim 1, further comprising a fourth rib located between the second and third ribs and wherein the first and fourth ribs are disposed on opposites sides from, and equal distances to, the throat center.

7. The dispenser of claim 1, further comprising fourth and fifth ribs and wherein the second and third ribs are located between fourth and fifth ribs.

8. The dispenser of claim 1, wherein the first, second, and third ribs have first, second, and third height profiles, respectively, and the second and third height profiles are greater than the first height profile at any given corresponding location along the profiles.

9. The dispenser of claim 7, wherein the fourth and fifth ribs have fourth and fifth height profiles, and wherein the fourth and fifth height profiles are greater than the second and third profiles at any given corresponding location along the profiles.

10. The dispenser of claim 1, further comprising fourth and fifth ribs and wherein fourth and fifth ribs are angled along their length towards the throat center at a greater angle than the angle of the second and third ribs.

11. A dispenser for storing and dispensing a plurality of paper products comprising:

a housing having first and second wall surfaces that define an interior space configured to accommodate the plurality of paper products;

a dispensing throat defined in one of the walls of the housing;

a plurality of ribs disposed on an interior surface of the wall defining the dispensing throat;

wherein the ribs include a first rib located near the center of the dispensing throat, and a second and third rib located farther from the center of the dispensing throat than the first rib and one on each side of the first rib; and wherein the second and third ribs are angled along their length towards the center of the dispensing throat at a greater angle than the angle of the first rib.

12. The dispenser of claim 11, wherein first, second, and third ribs have first, second, and third surfaces configured to form a boundary of a convex surface.

13. The dispenser of claim 11, wherein first, second, and third ribs have first, second, and third height profiles, respectively, and the second and third height profiles are greater than the first height profile at any given corresponding location along the profiles.

14. The dispenser of claim 11, wherein first, second, and third lengths are substantially linear.

15. The dispenser of claim 11, wherein first, second, and third lengths are substantially non-linear.

16. The dispenser of claim 11, further comprising fourth and fifth ribs and wherein fourth and fifth ribs are angled along their length towards the throat center at a greater angle than the angle of the second and third ribs.

* * * * *